US005887803A

United States Patent [19]

Dietrich et al.

[11] Patent Number: 5,887,803

[45] Date of Patent: Mar. 30, 1999

[54] PROCESS AND APPARATUS FOR GRINDING AND SIFTING A PRODUCT

[75] Inventors: Oliver Dietrich, Duesseldorf; Wilfried Duesberg, Duisburg; Manfred Stahl, Krefeld, all of Germany

[73] Assignee: Messer Griesheim GmbH, Germany

[21] Appl. No.: 699,924

[22] Filed: Aug. 20, 1996

[30] Foreign Application Priority Data

Sep. 7, 1995 [DE] Germany ..... 195 33 078.1

[51] Int. Cl.[6] ..... B02C 23/12; B02C 23/18

[52] U.S. Cl. ..... 241/23; 241/24.1; 241/27; 241/65; 241/79.1; 241/DIG. 14; 241/DIG. 37

[58] Field of Search ..... 241/23, 24.1, 24.11, 241/24.14, 17–18, DIG. 37, 65, 79.1, 79.2, 80, DIG. 14, 27

[56] References Cited

U.S. PATENT DOCUMENTS

| | | | |
|---|---|---|---|
| 3,921,917 | 11/1975 | Meinass | 241/DIG. 37 X |
| 4,406,411 | 9/1983 | Gall et al. | 241/23 X |
| 4,721,256 | 1/1988 | Lyman | 241/23 X |
| 4,863,106 | 9/1989 | Perkel | 241/23 X |
| 4,934,609 | 6/1990 | Lindauer et al. | 241/23 X |
| 4,962,893 | 10/1990 | Bochmann et al. | 241/23 X |
| 5,588,600 | 12/1996 | Perfido et al. | 241/23 |

FOREIGN PATENT DOCUMENTS

| | | | |
|---|---|---|---|
| 0044507 | 1/1982 | European Pat. Off. . | |
| 0317935 | 5/1989 | European Pat. Off. . | |
| 0 362 525 | 4/1990 | European Pat. Off. | 241/DIG. 37 |
| A-0 610 162 | 1/1994 | European Pat. Off. . | |
| 2609790 | 7/1988 | France | 241/DIG. 37 |
| C-935 762 | 11/1955 | Germany . | |
| 2318549 | 11/1973 | Germany . | |
| 27 43 766 | 4/1979 | Germany | 241/DIG. 37 |
| 30 18 777 | 11/1980 | Germany | 241/DIG. 37 |
| 26 30 803 C2 | 7/1986 | Germany . | |
| 3833830 | 4/1990 | Germany . | |
| A-38 33 830 | 4/1990 | Germany . | |
| 1747167 | 7/1992 | U.S.S.R. | 241/DIG. 37 |
| 1 581 030 | 12/1976 | United Kingdom . | |
| 1534274 | 11/1978 | United Kingdom | 241/DIG. 37 |
| 86/00827 | 2/1986 | WIPO | 241/DIG. 37 |

*Primary Examiner*—John M. Husar
*Attorney, Agent, or Firm*—Connolly & Hutz

[57] ABSTRACT

The invention relates to a process and an apparatus for grinding and sifting a product, in which the product is embrittled by a coolant and is comminuted in a mill (8), the comminuted product being fed, after comminution while keeping away ambient air and the moisture this involves, to a sifter (14). With the process and the apparatus according to the invention, the product can be comminuted and sifted in a closed-loop process without separating agents having to be fed to the ground product prior to sifting to overcome electrostatic charging. The sifter (14) is preferably operated with the gaseous coolant which is used to operate the mill (8) so that any losses of sifter circuit gas occurring during sifting can be compensated by feeding in a gaseous coolant. The total duration of the process can be reduced considerably.

13 Claims, 2 Drawing Sheets

PROCESS AND APPARATUS FOR GRINDING AND SIFTING A PRODUCT

BACKGROUND OF THE INVENTION

According to the prior art, during cold grinding, a product to be comminuted, in particular plastic, is embrittled by cooling with a coolant and is fed to a mill for comminution. The comminuted product leaves the mill in a cold state, is collected and stored temporarily, during which time the temperature of the ground product adapts to the ambient temperature. During this storage, electrostatic charging which has formed on the ground product can die away. In order to improve the subsequent sifting of the ground product, in many cases a separating agent is added. The latter is admixed with the ground product. During sifting, the oversize grain is separated from the fines and can be fed to the grinding process again. While the temperature of the ground product adapts to the ambient temperature during the temporary storage, water from the ambient air condenses on the particles of the ground product. As a result, the siftability of the ground product is severely restricted. Intermediate drying and adding separating agents therefore cannot be dispensed with for sifting in the previous cold grinding process. The operating stages involved with this are time-consuming and costly.

For instance, the production of fines has to be interrupted for the duration of temporary storage, and costs are incurred for the use of the separating agent and the work this involves.

German Patent Specification 38 33 830 C2 shows an apparatus of the applicant for the manufacture of extremely fine dusts with particle sizes up to less than 10 micrometers, which includes a sifter. EP 0,044,507 A1 describes a process in which labels are separated from plastic items by sifting. EP 0,317,935 B1 illustrates an apparatus in which the cold gas emerging from a mill is freed from particles by means of a cyclone. In German Offenlegungsschrift 23 18 549, the product comminuted by cold grinding is sized by means of a screening device. The publications cited in the prior art relate either to the manufacture of extremely fine dusts or they are based on different objects. For instance, in EP 0,044,507 A1, separation takes place not by particle size, but by material property.

SUMMARY OF THE INVENTION

The invention is therefore based on the object of providing a process and an apparatus with which the production of fines can be carried out in a cost-saving manner and with less time expenditure.

Using the process and the apparatus according to the invention, it is now possible to produce fines in a closed-loop process and without temporary storage. The gaseous coolant occurring in the mill can also be used for the sifting circuit.

THE DRAWINGS

The drawings in diagrammatic form illustrate an apparatus for carrying out the process according to the invention.

DETAILED DESCRIPTION

Figure 1:
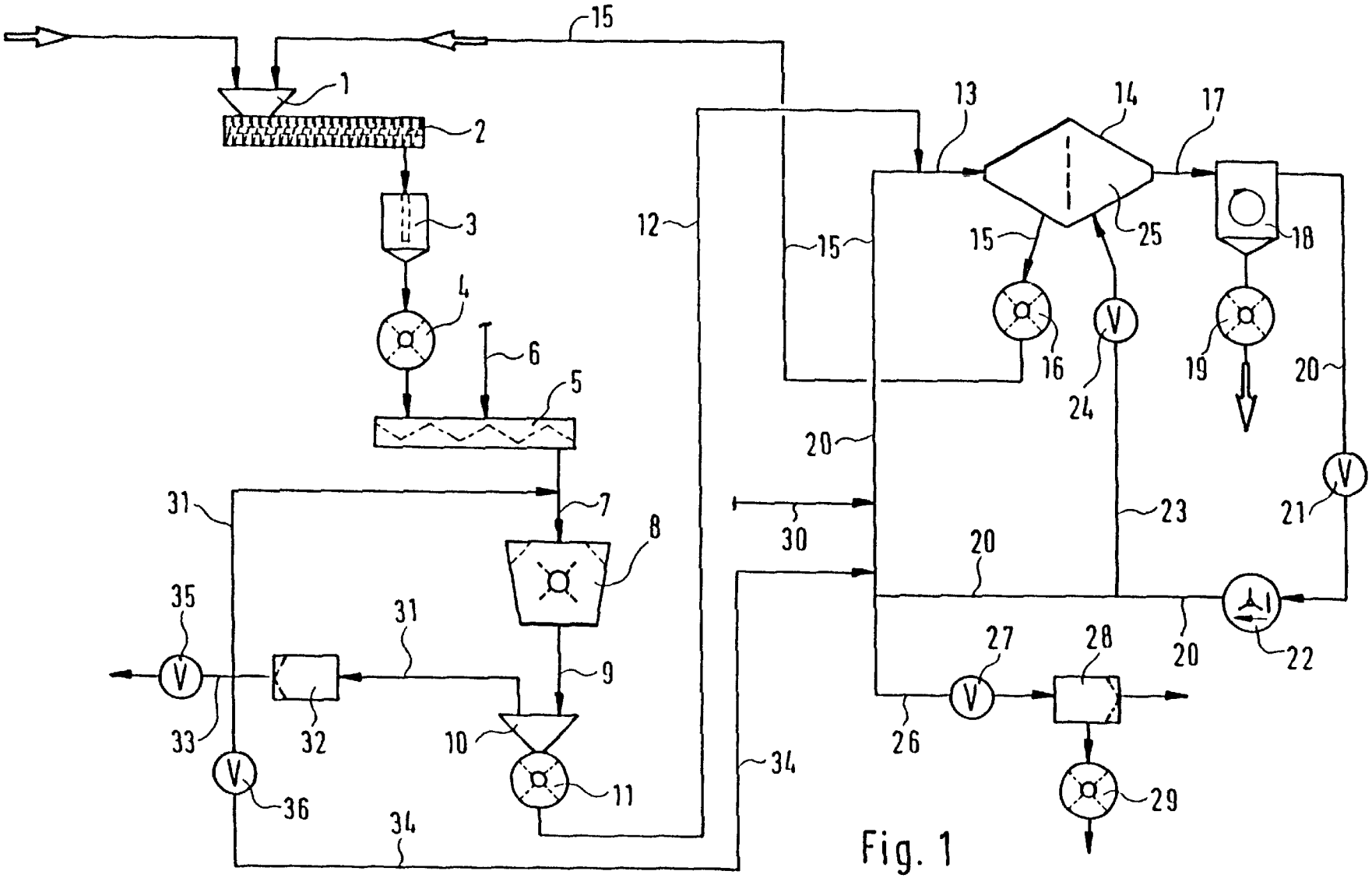
FIG. 1 shows an apparatus in which a sifter is attached to a mill.

In the apparatus illustrated in FIG. 1, the product is delivered by means of a funnel 1 onto a spiral conveyor 2 which feeds the product via a metal separator 3 to a cellular wheel sluice 4 which fills a cooling worm 5, charged with a liquid coolant by means of injection 6, with the product. The exit of the cooling worm 5 is connected via the line 7 to a mill 8 whose exit 9 communicates with a funnel 10 which leads into a cellular wheel sluice 11. A connection 12 leads from the cellular wheel sluice 11 to the line 13 which opens into an external sifter 14. From the sifter 14, a line 15 with a cellular wheel sluice 16 branches off and opens into the funnel 1, thus serving to return oversize grain. A further line 17 serves to lead fines away and opens into a cyclone 18 which is fitted on the exit side with a cellular wheel sluice 19. The line 20, which has a valve 21 and a fan 22, leads into the line 13 again. Branching off from the line 20 is a line 23 which is fitted with a valve 24 and which opens into the fines chamber 25 of the sifter 14. Furthermore, a line 26 branches off from the line 20 and opens via a valve 27 and a filter 28 into a cellular wheel sluice 29 and into the atmosphere. Located on the line 20 is a feed point 30 for liquid cooling medium. A line 31 with a filter 32 is connected to the funnel 10 and it returns gaseous coolant into the line 7. Branching off from the line 31 are the lines 33 and 34 which are fitted with the valves 35 and 36. Line 34 is connected to the line 20 and line 33 leads into the atmosphere.

Figure 2:
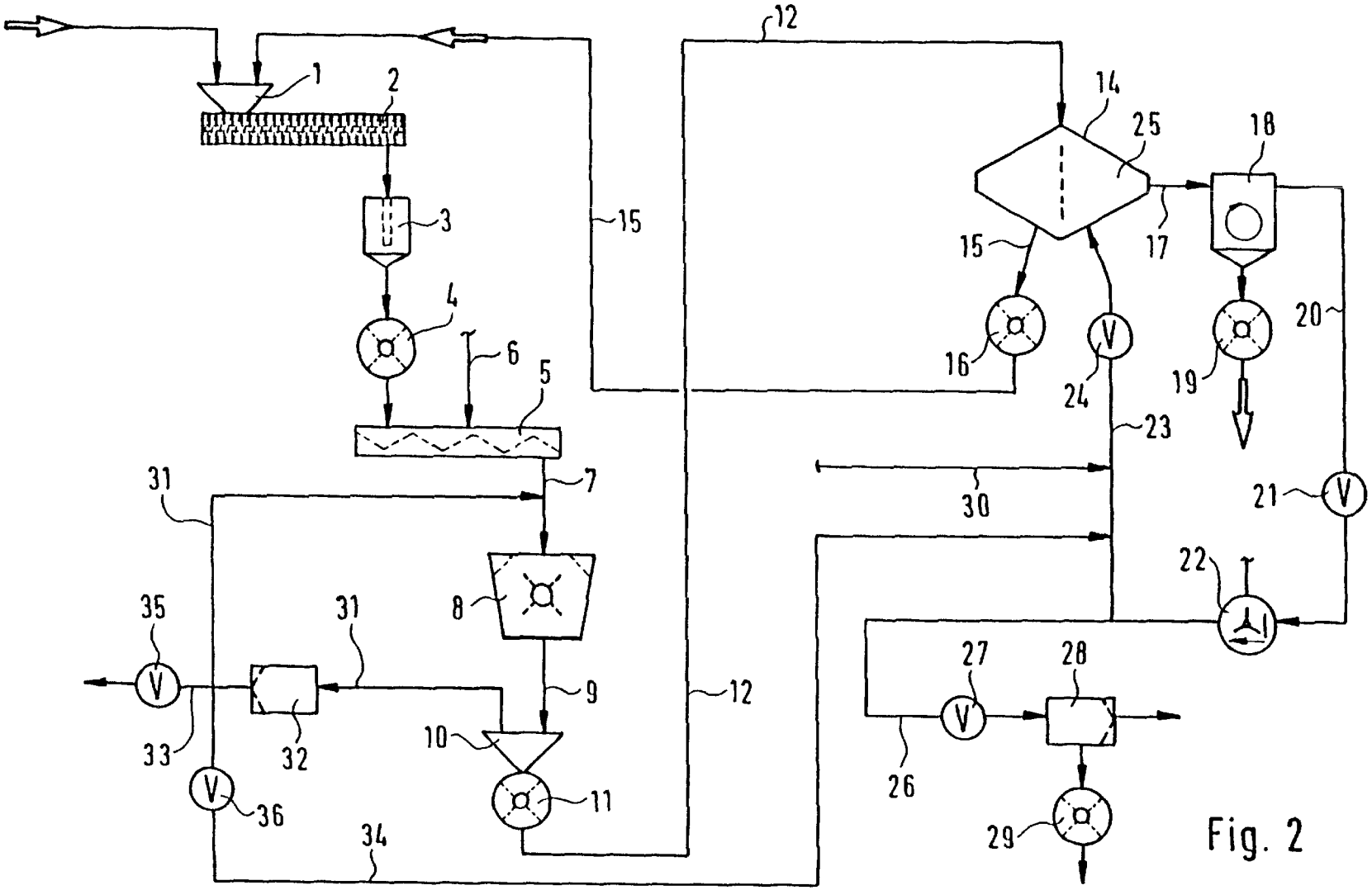
FIG. 2 shows a modification of the apparatus in FIG. 1.

In FIG. 2, the same reference numerals are assigned to the same features of the apparatus. The figure shows an apparatus in which the line 20 only continues into the lines 23 and 26, and the opening of the line 20 into the line piece 13 is omitted. The feed point 30 opens into the line 23.

During operation, the product is delivered via the funnel 1 onto the spiral conveyor 2 which brings the product via the metal separator 3 into the cellular wheel sluice 4 which feeds the product to the cooling worm 5. The liquid coolant, in this case liquid nitrogen, is introduced into the cooling worm 5 via the injection 6. As a result, the product is cooled and embrittled. The product pretreated in this manner is fed by the line 7 to the mill 8 which comminutes the product. The product comminuted in this way in the gas flow of the evaporated liquid nitrogen is fed via the exit 9 to the funnel 10 and to the cellular wheel sluice 11, from which the comminuted product is conveyed via the connection 12 in the cold gas flow into the sifter 14. The apparatus is sealed off from the atmosphere in a gastight manner along the route from the mill 8 via the exit 9, the funnel 10, the cellular wheel sluice 11 and the connection 12. This rules out any entry of ambient air and the moisture this involves. In the example illustrated in the drawing, the conveying of the ground product into the sifter 14 is guaranteed by the gas flow of the evaporating coolant through the line 12. However, it is also imaginable to use other apparatus elements, such as for example a further spiral conveyor, as driving means for conveying the comminuted product instead of such a gas flow. The comminuted product passes into the sifter 14 in the cold gas flow of the coolant via the line 13, in which sifter the oversize grain is separated from the fines. The oversize grain passes back into the funnel 1 via the line 15 and the cellular wheel sluice 16. The fines are conveyed via the line 17 into a cyclone 18 in which they are separated from the cold gas flow and are led away via the cellular wheel sluice 19. As shown in FIG. 1, the remaining cold gas passes through the line 20 via the fan 22 in the form of a guided circuit into the line 13 again, which feeds it to the sifter again. Further liquid nitrogen which evaporates in the line 20 can be fed into the line 20 via the feed point 30 in order to compensate for any losses of cold gas inside the sifter circuit. It is also possible to add a partial flow of the cold gas from the line 20 via the line 23 with the valve 24 to the fines chamber 25 of the sifter 14. Any overpressure occurring in the sifter circuit can be led away via the line 26 with the valve 27. For this purpose, the gas flow is conducted via a filter 28 which frees the cold gas emerging from the filter from particles which could pollute the environment. The separated particles can be segregated via a cellular wheel sluice 29 and collected. The line 31 which is likewise of gastight configuration branches off from the funnel 10 and passes via the filter 32 which again separates any particles occurring. The gas flow emerging from the filter and having a low temperature can be fed back into the line 7 in the circuit via the continuation of the line 31 in order to reduce the overall consumption of liquid nitrogen as the coolant.

Alternatively, excess cold gas can be given off to the atmosphere via the line 33 which is fitted with the valve 35. It is also possible to provide the sifter circuit with further cold gas from the grinding process by means of the line 34 which is fitted with the valve 36 by feeding the cold gas into the line 20 in order to compensate for any losses of circuit gas in the likewise closed sifter circuit.

In FIG. 2, the sifter gas circuit has a lesser extent and comprises only the fines chamber of the sifter, the line 17 with the cyclone 18, the line 20 with the fan 22 and the return line 23 with the valve 24.

It is now possible with the process and the apparatus according to the invention to produce and to sift fines on-line in a closed-loop sequence keeping out ambient air and the air humidity this involves without any further intermediate stages, such as conditioning, drying and adding separating agents. The time expenditure and costs can therefore be reduced to a considerable extent. Ideally, the process will be operated using liquid nitrogen which evaporates during the procedure. However, it is also possible to use other coolants which have similar properties. The process is not limited to the application of impact mills; on the contrary, other mills such as, for example, microvortex mills and air jet mills can also be used. Using the process and the apparatus, the coarse product delivered can be comminuted essentially down to a particle size of 50 micrometers in the main fractions. With the process and the apparatus according to the invention, the entry of air humidity is prevented. As a result, the product quality is improved and the subsequent separating stages are positively influenced to a significant extent; the addition of a separating agent is not required. Problems caused by electrostatic charging can be prevented. The circuit gas required for sifting is removed from the upstream cold grinding process, thus allowing dual utilization of the coolant. A sifter 14 with a sifter gas circuit is required for an economic mode of operation. However, under special circumstances, the process according to the invention can also be carried out with a sifting process without a sifter gas circuit.

In the case of liquid nitrogen being used as the coolant, both processes, the grinding and the sifting, are carried out, even simultaneously, using the inert gas. The risk of explosion is thus limited, in particular in the case of a product which is sensitive to oxygen. The previously required steps of mixing, adding a separating agent and temporary storage can be dispensed with; this involves a considerable reduction in personnel, operating and investment costs. The oversize grain fed back into the grinding system has already been cooled in the operation, which means that the consumption of coolant can be reduced. The process can be carried out particularly advantageously in on-line operation.

We claim:

1. A process for grinding and sifting a product comprising feeding the product from an inlet to an embrittling station where the product is embrittled by application of a coolant to the product, feeding the embrittled product from the embrittling station to a mill, comminuting the embrittled product in the mill, feeding the comminuted product away from the mill to a sifter having a sifter gas circuit between the mill and the sifter, using a gaseous coolant in the sifter circuit to convey the product while keeping out ambient air with the comminuted product being conveyed into the sifter in an atmosphere of the gaseous coolant, separating oversize grains from the fines of the comminuted product in the sifter, feeding the oversize grain from the sifter to the inlet for further grinding and sifting, feeding the gaseous coolant and the fines from the sifter, separating the fines from the gaseous coolant, removing the fines, and conveying the gaseous coolant which was separated from the fines back to the sifter.

2. The process as claimed in claim 1, including feeding part of the coolant used in the mill in a gaseous stage to the sifter gas circuit in order to compensate for losses of gasses and losses of cold in the sifter gas circuit.

3. The process as claimed in claim 1, including feeding a part of the coolant used in the mill back to the mill in a gaseous state.

4. The process as claimed in claim 1, including operating the sifter gas circuit with coolant which is used for embrittling.

5. The process as claimed in claim 1, including comminuting the embrittled product in an impact mill.

6. An apparatus for grinding and sifting a product comprising an inlet station for receiving the product, an embrittling station downstream from and in flow communication with the inlet station for embrittling the product in the embritting station by the application of a coolant to the product in the embriling station, a mill downstream from and in flow communication with the embrittling station for comminuting the embrittled product into oversize grains and fines, a sifter downstream from the mill, a sifter gas circuit containing gaseous coolant joining the mill to the sifter for conveying the comminuted product from the mill to the sifter while keeping out ambient air to convey the comminuted product in an atmosphere of the gaseous coolant, an oversize grain return line from the sifter to the inlet for returning oversize grain to the inlet for further grinding and sifting, a separating station downstream from the sifter for separating the fines from the gaseous coolant and removing the fines, and gaseous coolant return lines leading from the separating station back to the sifter to return the gaseous coolant separated from the fines back to the sifter.

7. The apparatus as claimed in claim 6, wherein a line which is connected to the entry side of the mill is attached to the exit side of the mill.

8. The apparatus as claimed in of claim 6, wherein a filter is integrated in the line which branches off from the mill on the exit side.

9. The apparatus as claimed in claim 6, wherein the line of the sifter gas circuit is assigned a gas outlet which comprises a filter with a particle outlet.

10. The apparatus as claimed in claim 6, wherein a line which is connected to the entry side of the mill is attached to the exit side of the mill.

11. The apparatus as claimed in claim 6, wherein a filter is integrated in the line which branches off from the mill on the exit side.

12. The apparatus as claimed in claim 6, wherein the line of the sifter gas circuit is assigned a gas outlet which comprises a filter with a particle outlet.

13. The apparatus as claimed in claim 6 wherein the mill is an impact mill.

* * * * *